United States Patent [19]

Kintner

[11] 4,234,993

[45] Nov. 25, 1980

[54] CONDENSER CLEANING SYSTEM USING SPONGE BALLS

[76] Inventor: Edwin K. Kintner, R.D. 4 A231, Johnstown, Pa. 15905

[21] Appl. No.: 43,617

[22] Filed: May 30, 1979

Related U.S. Application Data

[63] Continuation-in-part of Ser. No. 873,006, Jan. 27, 1978, abandoned.

[51] Int. Cl.[3] ..... B08B 9/04

[52] U.S. Cl. ..... 15/104.06 A; 165/95

[58] Field of Search ..... 15/104.06 A, 3.5, 3.51; 165/95; 122/379, 396

[56] References Cited

U.S. PATENT DOCUMENTS

| | | | |
|---|---|---|---|
| 1,795,348 | 3/1931 | Schmidt | 15/3.5 X |
| 2,539,354 | 1/1951 | Minyard | 15/104.06 R X |
| 2,801,824 | 8/1957 | Taprogge | 15/3.51 X |
| 3,135,322 | 6/1964 | Neugebauer | 165/95 |
| 4,079,782 | 3/1978 | Soderberg et al. | 165/95 |

FOREIGN PATENT DOCUMENTS

| | | | |
|---|---|---|---|
| 525076 | 12/1953 | Belgium | 165/95 |
| 1238939 | 4/1967 | Fed. Rep. of Germany | 165/95 |
| 1247359 | 8/1967 | Fed. Rep. of Germany | 165/95 |

*Primary Examiner*—Edward L. Roberts

*Attorney, Agent, or Firm*—William J. Ruano

[57] ABSTRACT

A system for cleaning the tubes of a condenser or other heat exchanger unit by circulating sponge balls therethrough by a circulating pump, comprising the improvement in the form of a screen assembly including four vertical screens about 90° apart, two of which confront the discharge end of said condenser to divert the sponge balls downwardly through an internally spiralled stationary tube, while the other two screens confront the discharge pipe of the system. By turning the screens 180°, they are completely flushed of debris without the need of removing the balls to an accumulator and stopping circulation of the balls during the screen cleaning operation. Higher efficiency, elimination of down time and lower maintenance costs are provided.

6 Claims, 5 Drawing Figures

CONDENSER CLEANING SYSTEM USING SPONGE BALLS

This invention is a continuation-in-part of my patent application Ser. No. 873,006 filed Jan. 27, 1978 now abandoned.

This invention relates to a cleaning system for tubes in a condenser or other heat exchange units.

In the past, condensers and the like have been cleaned by circulating sponge balls therethrough, somewhat snuggly fitted, to wipe the scale or deposits formed on the inner surface. Screens were used for catching the balls at the outlet of the condenser. However, such screens accumulated so much debris that it was necessary to frequently remove all the balls circulating in the system and to place all such balls in an accumulator, then place the screens in a screen cleaning position to wash the debris away, and finally remove the balls from the accumulator and put them back in circulation,-all of which took several hours and limited the circulation of cleaning balls, perhaps up to 30% of the operating time. The accumulation of the balls also prevented their breaking up the laminar flow through the condenser tubes, which flow tends to reduce the efficiency of heat transfer.

An object of the present invention is to overcome the above-named disadvantages by eliminating the necessity of accumulating the balls in an accumulator and thereby enabling continuous circulation of the balls, even while the screens are being cleaned of debris, so as to substantially increase heat transfer efficiency.

Another object is to considerably reduce operating costs of the system.

A more specific object is to provide a novel screen of such construction that rotation thereof by 180° will confront a cleaned pair of screens while exposing a dirty pair of screens to flushing or washing of accumulated debris.

Other objects and advantages will become more apparent from a study of the following description taken with the accompanying drawings wherein.

Figure 1:
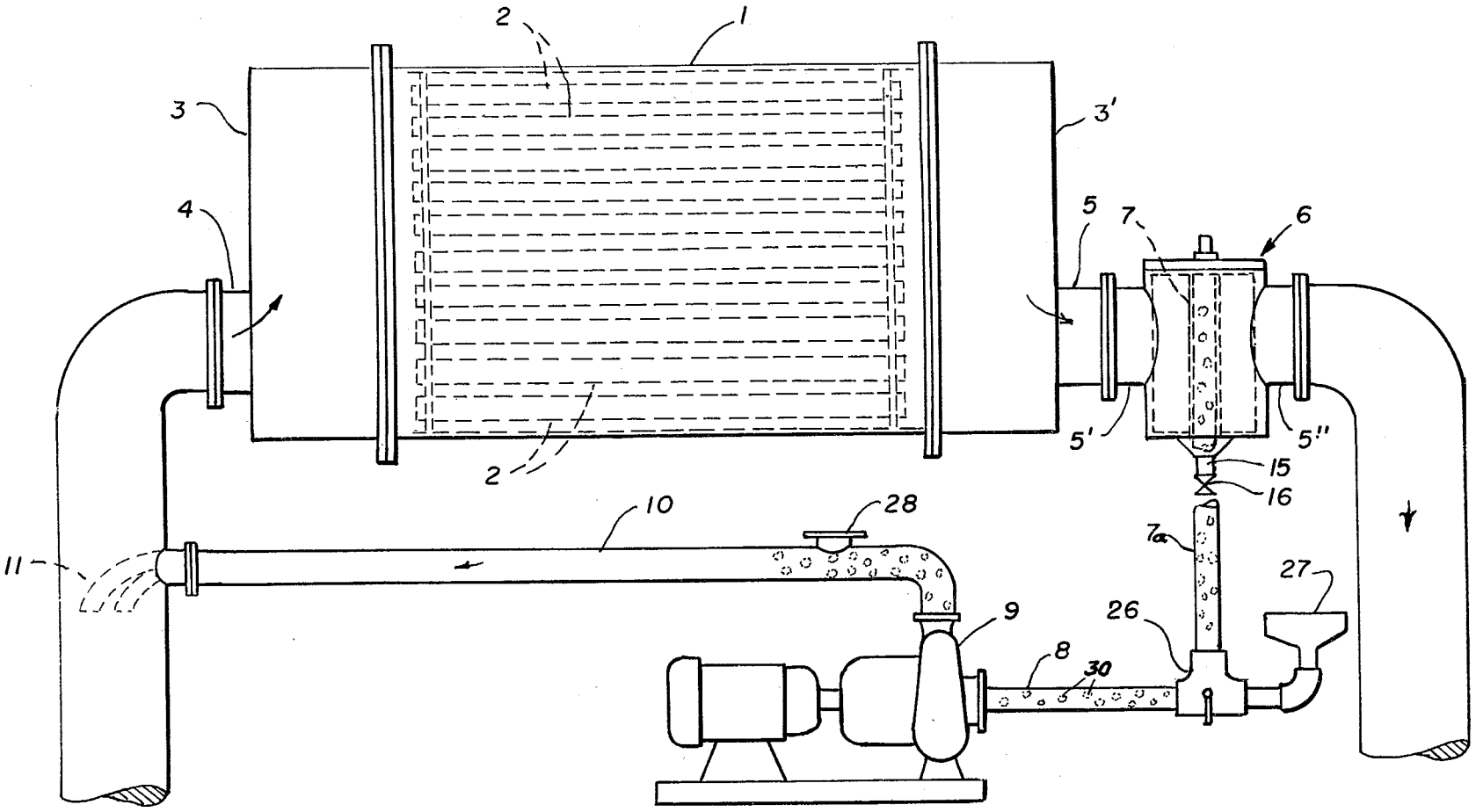
FIG. 1 is an elevational view of a cleaning system for a condenser including the novel screen embodying the present invention.
Figure 2:
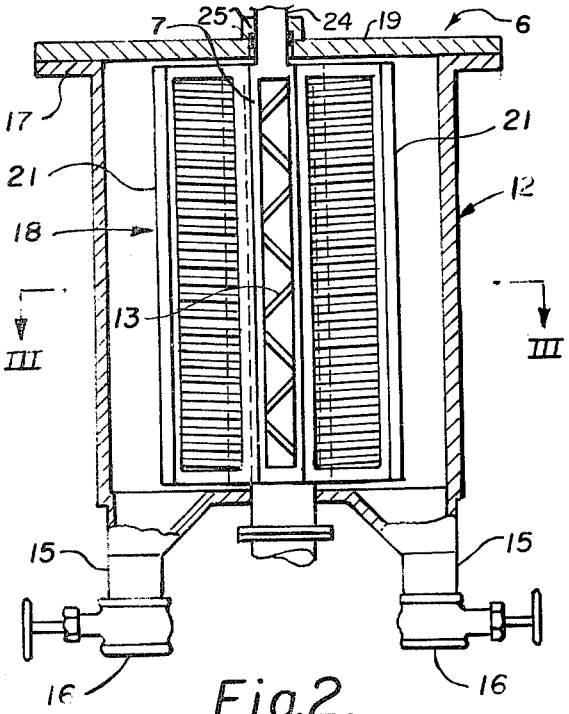
FIG. 2 is an enlarged vertical cross-sectional view taken along line II—II of FIG. 3 of the novel screen assembly.

Referring more particularly to FIG. 1, numeral 1 denotes a condenser or other heat exchanger unit including inlet and outlet plenums 3 and $3^1$, respectively, an inlet pipe 4 fed from a suitable water source and an outlet pipe 5 connected to pipe portions $5^1$ and $5^{11}$ forming component parts of a strainer or screen assembly 6 embodying an essential portion of the present invention.

The screen assembly 6 includes a slotted ball catching tube 7 for discharging sponge balls 30 of spherical, octagonal or other shapes, about $\frac{7}{8}''$ to 1" in diameter, which balls are discharged through discharge tube 7*a* leading to suction pipe 8 of a pump 9 which circulates the balls through discharge pipe 10 and injecting nozzles 11 so as to recirculate the balls through inlet pipe 4 and back through the condenser tubes 2.

When new balls are to be added, the handle of a 3-way valve 26 is turned to allow entry of a new supply of balls in hopper 27. At selected points of the piping, observation glasses 28 are placed. It will be particularly noted that there is no accumulator needed in the system in view of the novel construction of the strainer assembly including a novel arrangement of the screens.

Referring more particularly to FIGS. 2 to 5 inclusive, numeral 7 denotes a ball catching tube having mounted therein a spiral strip 13. The tube 7 has an opening 14 (FIG. 3) so that balls may enter the tube and be guided, by the spiral strip 13, in a downward direction through discharge tube 7*a* (FIG. 1). If spiral strip 13 were not mounted in tube 7, the balls would tend to stay at the top of the tube rather than to be discharged downwardly therethrough. Therefore, spiral strip 13 provides an important feature of the screen assembly.

Pivotally mounted on top of stationary tube 7 is a pivotal screen and frame assembly comprising a circular bearing 31 rigidly secured to four screens 22 through tubular frame 31*a*. The screens 22 are preferably $\frac{1}{4}''$ diameter rods spaced $\frac{1}{4}''$ apart and slanted to direct the balls to tube 7.

It is important to note that the screens need not be sealed along their perimeter but instead come to with $\frac{1}{8}''$ of the sides and top and bottom and that they are positioned by the operator. There are no stops in the body 12 to position the screens. This eliminates wear. It is also important to note that the screens are never in the main flow at the entrance point, but are back a short distance so that balls will not hang up at that point.

Openings 23, 23 of the rotatable screen and frame assembly can be placed in registry with opening 14 of tube 7. The four screens 22 are preferably at 90° apart. The screen and frame assembly may be driven or turned to different angular positions by drive shaft 24 which may be driven by a handle through reduction gearing (not shown). A stuffing box 25 enables turning of the shaft 24 relative to the top cover or flange 19 integrally secured to flange 17 of the strainer body 12.

Figure 3:
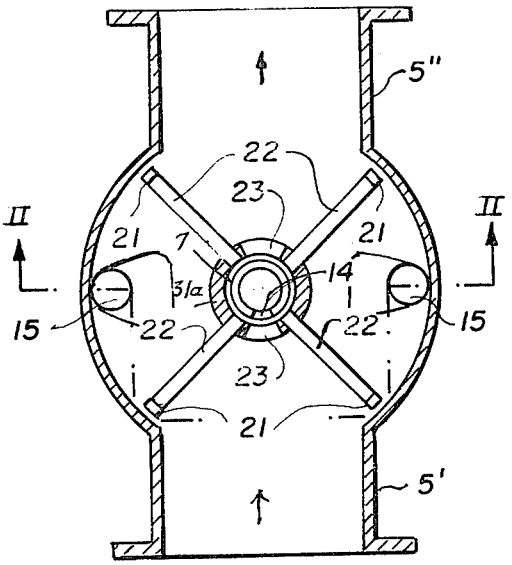
FIG. 3 is a cross-sectional view taken along lines III—III of FIG. 2.
Figure 4:
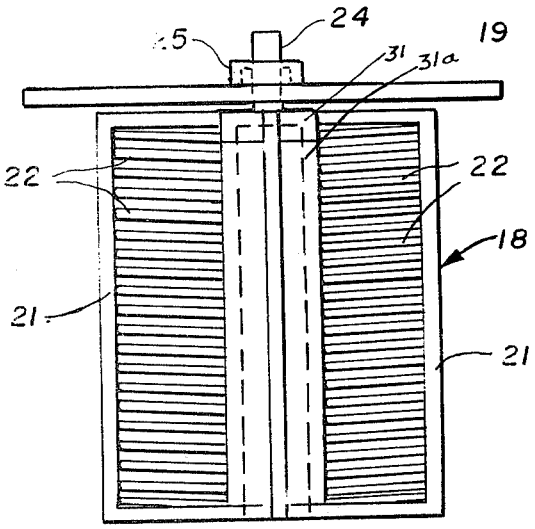
FIG. 4 is an elevational view of the screen assembly.
Figure 5:
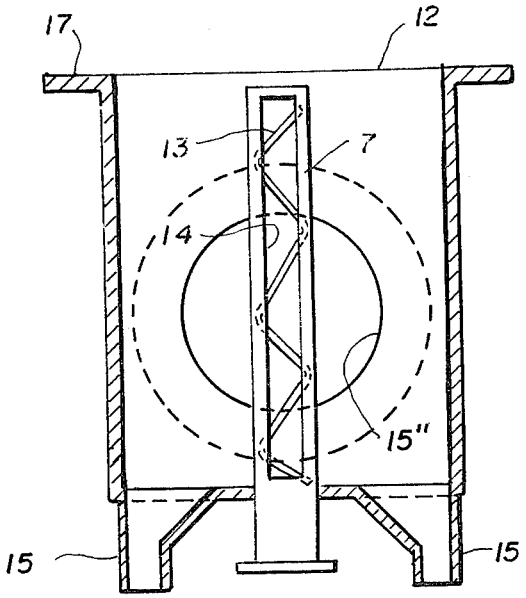
FIG. 5 is a vertical cross-sectional view more clearly showing the ball discharge tube.

A unique feature is provided by the four radially extending screens 22 in that when they are in the position shown in FIG. 3, after debris collects on the confronting surfaces for incoming balls, it is necessary merely to rotate the screen assembly by 180° to expose the debris to the discharge and $5^{11}$ and thereby allow the debris to be easily pushed away from the surfaces thereof into the discharge pipe.

In some instances, it is desirable to discharge the debris in a separate waste system instead of into the discharge pipe. In such event, valves such as 16, are provided, which are normally closed. However, when it is desired to clean the screens, the screens are rotated only 90° to clean one side of the screen and the debris collected thereon is discharged into the separate waste system by opening value 16, then reversed 180° to clean the other side of the screen and finally turned 90° in the reverse direction to put them back into the normal position shown in FIG. 3. If valves 16 are eliminated, it is necessary merely to turn the screen assembly 180° to confront the entry with a clean pair of screens while the other pair is being cleaned or flushed with water to discharge the debris into the discharge pipe 5". If a ball accumulator is desired; it may be inserted in line 10.

Thus it will be seen that I have provided an efficient condenser tube cleaning system and particularly the screen assembly thereof which enables elimination of the ball accumulator and the necessity of removing the balls from the system while cleaning the screens, thereby allowing continuous circulation of the balls for cleaning, thus maintaining a high efficiency of heat transfer of the condenser tubes at all times without interruption,-also which eliminates the necessity of a seal with the inner surface of the strainer body; moreover, I have provided a ball cleaning system for condensers and similar heat exchanger units which greatly reduces operating and maintenance costs; also I have provided a system which can discharge the debris into a separate waste instead of in the condenser discharge pipe.

While I have illustrated and described a single specific embodiment of my invention, it will be understood that this is by way of illustration only and that various changes and modifications are contemplated within my invention and the following claims:

I claim:

1. In a cleaning system for the tubes of a condenser or other heat exchanger device including a pump for circulating sponge balls through said tubes, the improvement comprising a screen assembly connected to the discharge end of said tubes, said screen assembly including a vertical discharge tube for receiving said balls, four rectangular screens rotatable about said discharge tube and radiating from a central pivotal axis in a substantially cylindrical body having an inlet and an outlet, two of said screens confronting the inlet of said body and discharge end of said tubes for guiding said balls into said vertical discharge tube and into the suction said of said circulating pump, and shaft means for turning said screen assembly about said pivot, whereby turning thereof through 180° will expose debris accumulated on said two of said screens to the outlet end of said substantially cylindrical body.

2. A cleaning system as recited in claim 1 wherein said screens have a clearance of the order of ⅛" with the inner side and bottom walls of said substantially cylindrical body.

3. A cleaning system as recited in claim 1 together with a vertically spiral strip in said vertical discharge tube to assist said balls to move downwardly therethrough.

4. A cleaning system as recited in claim 1 wherein said screens are substantially 90° apart.

5. A cleaning system as recited in claim 1 wherein said screens are mounted on a frame which is rotatably mounted on the top of said vertical discharge tube, which tube is stationarily mounted in said body.

6. A cleaning system as recited in claim 1 together with a pair of discharge valves connected to the bottom of said body connected to a separate waste system, said pair of discharge valves being about 180° apart and located in the sectors of said body intermediate said pairs of screens confronting the inlet and outlet of said body so as to enable debris collected on said screens to be discharged into a separate waste system by turning said screens 90° in one direction, then 180° in the opposite direction, then reversed 90° to the normal position.

* * * * *